US005086577A

United States Patent [19]

Abernethy

[11] Patent Number: 5,086,577

[45] Date of Patent: Feb. 11, 1992

[54] WRITING INSTRUMENT ADVERTISING DEVICE

[76] Inventor: Robert R. Abernethy, 6541 Brookhill Dr., Garfield Hts., Ohio 44125

[21] Appl. No.: 304,204

[22] Filed: Jan. 31, 1989

[51] Int. Cl.[5] ..... G09F 3/00

[52] U.S. Cl. ..... 40/334; 401/194; 40/905

[58] Field of Search ..... 40/334, 335, 905; 401/195, 194

[56] References Cited

U.S. PATENT DOCUMENTS 3,846,927 11/1974 Geffen ..... 40/334

FOREIGN PATENT DOCUMENTS 510262 9/1953 Belgium ..... 40/334

3800212 8/1989 Fed. Rep. of Germany ..... 40/334

2489753 3/1982 France ..... 401/221

*Primary Examiner*—Randall L. Green

*Assistant Examiner*—David H. Willse

[57] ABSTRACT

The combination of a writing instrument such as a ballpoint pen having a pushbutton at the upper end and an advertising device wherein the advertising device is supported on a sleeve preferably in a freely rotatable manner with the pushbutton being received within the sleeve and secured thereto so as to position the advertising device upwardly from the pen upper end whereby the advertising device is readily viewable by an observer, a depression of the advertising device thereby producing a concomitant depression of the pushbutton to extend and retract the writing tip of the pen.

10 Claims, 1 Drawing Sheet

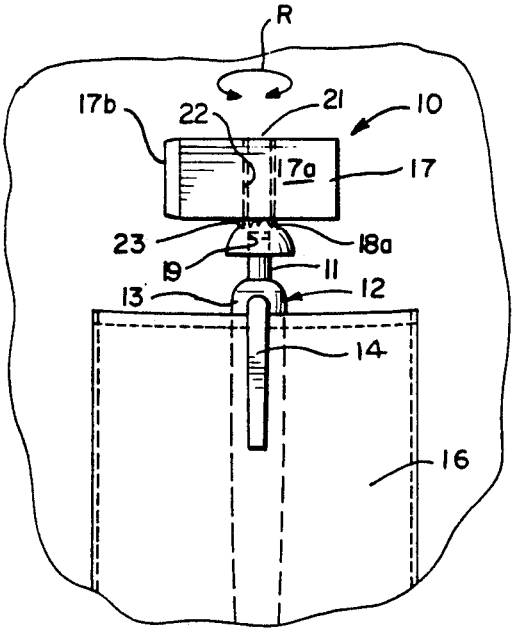
FIG. 1
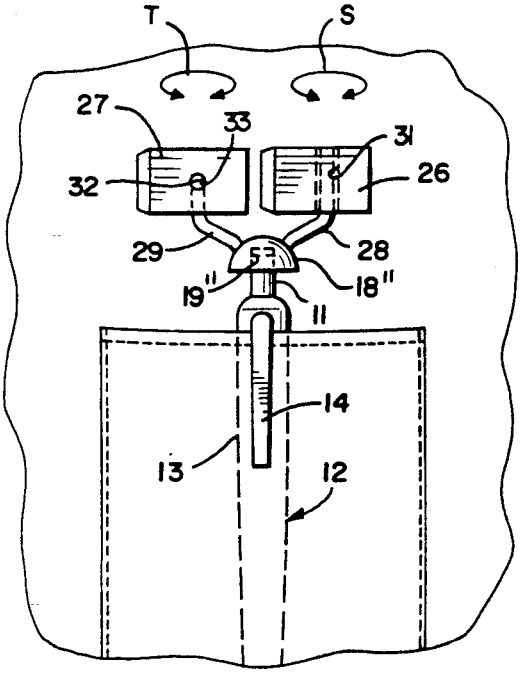
FIG. 2
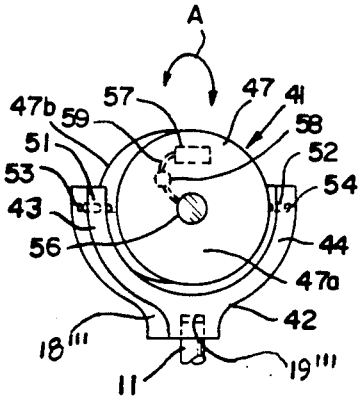
FIG. 3
FIG. 4a
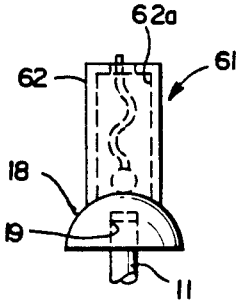
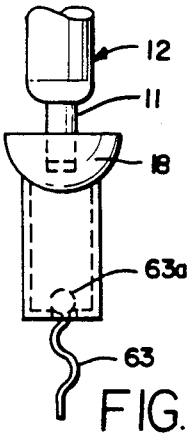
FIG. 4b
FIG. 5
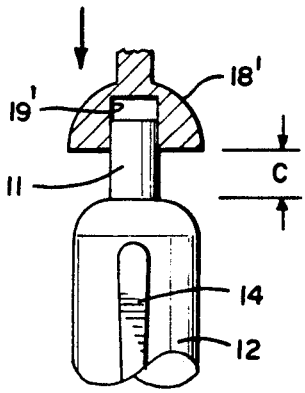
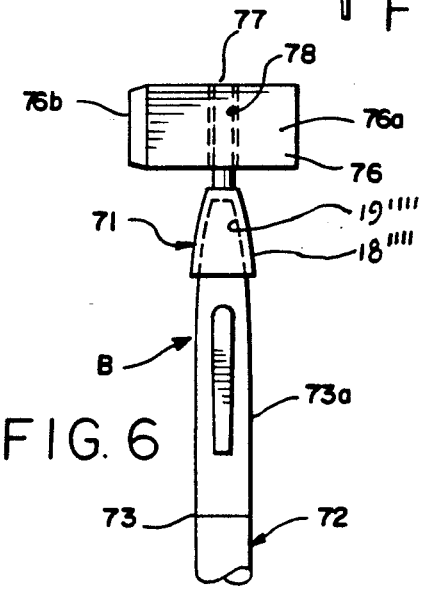
FIG. 6

WRITING INSTRUMENT ADVERTISING DEVICE

This invention relates to a writing instrument and, more particularly, to an advertising device which is attached to a writing instrument such as a pencil, conventional pen, ballpoint pen and the like.

BACKGROUND OF THE INVENTION

A popular form of advertisement by companies, organizations, political parties and the like is to utilize writing instruments such as pens and pencils on which the name, logo, etc. of the entity is inscribed. This is usually accomplished by printing or inscribing the identifying indicia of the entity on the barrel of the instrument by the manufacturer or by an intermediary in a batch-type operation.

The common technique in use today is to apply such advertising indicia to the barrel of the pen or pencil in any well-known manner. Note only is such a technique expensive and requires set-up time for each customer but when the useful life of the instrument is over, the instrument with the indicia thereon is discarded. Even with ballpoint pens having replaceable cartridges, the time and expense of replacing the cartridge induces the user to simply replace the useless instrument with a new pen. Furthermore, as the advertising indicia is usually applied to the pen barrel, the hand of the user obscures the indicia during use losing some of the effect of the pen as an advertising medium.

In a departure from the common technique of inscribing the advertising indicia on the barrel of the writing instrument, U.S. Pat. No. 2,574,615 issued to H. W. Brewer shows an advertising device applied to the top of a pencil or the like. However, in the Brewer patent, a screw-threaded mounting arrangement is used so that modification of the pencil is required. Furthermore, such an arrangement could not be used on a ballpoint pen.

U.S. Pat. No. 3,639,069 issued to R. S. Gordon shows a container detachably mounted on the upper end portion of a pen or pencil of the ballpoint type but such a container is totally different from an advertising device and cannot be considered as such.

OBJECTS AND SUMMARY OF THE INVENTION

Accordingly, a primary object of the invention is to provide a new and novel advertising device for a writing instrument.

Another object of the invention is to provide a new and novel advertising device for a writing instrument which may be easily attached to any pen or pencil without modification.

A further object of the invention is to provide a new and novel advertising device for a writing instrument such as a retractable ballpoint pen which does not interfere with the operation of the pushbutton for extending and retracting the writing tip.

Still another object of the invention is to provide a new and novel advertising device for a writing instrument which may be manufactured in a variety of forms, which may be provided with illuminating and audible components and which may be easily removed and reused.

A still further object of the invention is to provide a new and novel advertising device for a writing instrument which may be used either a ballpoint pen having a pushbutton or a ballpoint pen having a rotatable barrel portion.

The objects of the invention and other related objects are accomplished by the provision of a writing instrument such as a ballpoint pen, pencil or the like having a lower end provided with a writing tip and an upper end. An advertising device provided with advertising indicia and having a sleeve is securely mounted on the upper end of the instrument such as on the actuating pushbutton of a ballpoint pen by accommodation of the upper end or pushbutton of the instrument with the sleeve and secured therein by an adhesive, sonic welding or the like to prominently display the advertising indicia during use or otherwise with the advertising device being freely rotatable on the sleeve in one form and, if desired, provided with illumination.

BRIEF DESCRIPTION OF THE DRAWING

Various embodiments of the present invention are described, in detail, with reference to the drawing wherein:

FIG. 1 is an elevation view of the writing instrument of the invention positioned within the shirt pocket of a user;

FIG. 2 is a partial view in elevation of a second embodiment of the writing instrument of the invention;

FIG. 3 is an elevation view of a third embodiment of the invention;

FIG. 4*a* is a fragmentary view of a fourth embodiment of the invention with the writing instrument in an upright position;

FIG. 4*b* is a fragmentary view of the embodiment of FIG. 4*a* in an inverted position;

FIG. 5 is a fragmentary view partially in section of the writing instrument of the invention; and FIG. 6 is a fragmentary view of a fifth embodiment of the writing instrument of the invention.

DESCRIPTION OF THE PREFERRED EMBODIMENTS

Referring now to the drawing and to FIG. 1 in particular, there is shown one embodiment of the advertising device of the invention which is designated generally by the reference numeral 10. In FIG. 1, the advertising device 10 is shown mounted on the upper end of a writing instrument and more specifically, the pushbutton 11 of a pen such as a ballpoint pen 12 having a barrel 13 and a retractable writing tip (not shown) of well-known construction. It should be understood that the advertising device of the invention may be attached to a wide variety of writing instruments such as other types of pens, pencils or the like.

In FIG. 1, the pen 12 is provided with a conventional clip 14 and is shown with the clip 14 in engagement with the upper edge portion of the pocket 16 of a shirt worn by a user in the well-known manner.

The advertising device 10 includes a planar member 17 having opposite faces 17*a*, 17*b* with selected advertising indicia on at least one of the faces. The advertising device 10 also includes a sleeve 18 having a recess 19 on which the planar member 17 is mounted. The sleeve recess 19 is arranged to accommodate the pushbutton 11 which is secured thereto by means such as an adhesive, a press fit, sonic welding or the like.

Preferably, the planar member 17 is mounted on the sleeve 18 for free rotation. More specifically, an upstanding spindle 21 is suitably mounted on the sleeve 18, the sleeve being loosely received within a central bore 22 provided in the planar member 17. Thus, the planar member 17 may rotate freely in both directions as indicated by the arrows R. If desired, the upper surface 18*a* of the sleeve 18 may be knurled for engagement by a downwardly extending detent 23 on the bottom edge of the planar member 17 thereby frictionally limiting the free rotation of the planar member 17.

The advertising device 10 therefore prominently displays the indicia thereon when used or in the storage position within the shirt pocket 16. Furthermore, pushing downwardly on the top of the device 10 depresses the pushbutton 11 to extend and retract the writing tip of the ballpoint pen 12.

FIG. 5 is an enlarged view partially in section illustrating the mounting arrangement of the sleeve 18 on the pushbutton 11 of the pen 12. Note that the upper end of the pushbutton 11 extends partially into the sleeve recess 19 leaving an exposed portion designated by the letter C so that full downward travel of the pushbutton is permitted without interference by the sleeve 18.

Referring now to FIG. 2 wherein like numerals are used to identify like parts, there is shown a second embodiment of the invention wherein a pair of planar members 26, 27 are provided which are arranged in laterally spaced-apart relationship. The members 26, 27 are similar in shape to the planar member 17 of FIG. 1 and include opposite faces on at least one of which suitable advertising indicia may by provided.

In the embodiment of FIG. 2, a pair of upstanding first and second support members 28, 29 are suitably attached to the sleeve 18 in laterally spaced relationship each of which are associated with a planar member 26, 27 respectively. Means are provided for mounting the planar members 26, 27 on the support members 28, 29 for free rotation in the direction of the arrows S, T respectively.

More specifically, the first support member 28 extends through a central bore 31 in the planar member 26 as in the embodiment of FIG. 1 so that the member 26 rotates freely on a vertical axis in the direction of the arrows S. The upper end of the second support member 29 is formed with a spindle 32 extending in right angle relationship therewith and which may be formed integrally with the member 29. The planar member 26 is provided with a central bore 33 for accommodating the spindle 32 so that the planar member 27 is freely rotatable in the direction of the arrow T on a horizontal axis.

Referring now to FIG. 3, a third embodiment of the invention is shown which is adapted to be mounted on a writing instrument (not shown) as described above and which is designated generally by the reference numeral 41. The advertising device 41 includes a yoke 42 having spaced-apart arcuate leg portions 43, 44 and a base portion 45 having a recess 46 defining a sleeve.

A disc 47 having opposite faces 47*a*, 47*b* on at least one of which suitable advertising indicia is inscribed is provided and a pair of oppositely disposed spindles 51, 52 are provided on the peripheral edge of the disc in diametrically aligned relationship. The spindles 51, 52 are received within suitable apertures 53, 54 with the leg portions 43, 44 respectively. Thus, the disc 47 is freely rotatable in the directions of the arrows A, the device 41 being mounted on the pushbutton 11 as in the previous embodiments.

Furthermore, the disc 47 may be provided with illuminating means such as an LED lamp 56 connected to a source of power such as a battery 57 through a switch 58 by means of conductors 59 for further directing the attention of an observer to the advertising indicia on the disc.

In FIGS. 4*a*, 4*b*, there is shown another embodiment of the invention wherein like numerals are used to identify like parts. As shown in FIG. 4*a*, the advertising device designated generally by the reference numeral 61 includes an upstanding hollow tubular member 62 suitably secured by welding or the like to the top of the sleeve 18. Disposed within the interior 62*a* of the tubular member 62 is a serpentine member 63 freely movable between a retracted position as shown in FIG. 4*a* and when the writing instrument is in an upright position and an extended position when the writing instrument is in an inverted position as shown in FIG. 4*b*, the serpentine member 63 moving under the action of gravity. By means of a stop member 63*a* on the inner end of the serpentine member 62, the movement of the serpentine member is limited to the extended position of FIG. 4*b*.

Referring now to FIG. 6, there is shown still another embodiment of the advertising device of the invention which is designated generally by the reference numeral 71. In the embodiment of FIG. 6, a ballpoint pen 72 is provided which is of the well-known type wherein a clockwise or counterclockwise rotation of the upper portion 73*a* of the pen barrel 73 provides a retraction and extension of the writing tip as indicated by the arrow B. The device 71 includes a sleeve 74 having a recess 74*a* in which the upper end of the pen 72 is secured as in the previous embodiments.

A planar member 76 similar to the embodiment of FIG. 1 and having opposite faces 76*a*, 76*b* on at least one of which suitable advertising indicia is provided is supported for free rotation on the sleeve 74. The is accomplished by means of upstanding spindle 77 suitably mounted on sleeve 74 and extending loosely through a central bore 78 in the planar member 76.

What is claimed is:

1. In a writing instrument of the type including a barrel having a lower end provided with a retractable writing tip and an upper pushbutton end and means for actuating the movement of said writing tip between a retracted position and an extended position, an improvement which comprises an advertising device affixed to a sleeve, said advertising device being provided with advertising indicia viewable by an observer, means for permanent mounting of said sleeve on said upper pushbutton end and allowing movement of said tip, without removing said device with said advertising device extending upwardly for viewing of said indicia by an observer.

2. A writing instrument in accordance with claim 1 wherein said advertising device is mounted on said sleeve for free rotation.

3. In a writing instrument of the type having a two barrel assembly wherein rotation of one of said barrels in a clockwise or counterclockwise direction provides an extension or retraction, respectively, of said writing tip, an improvement which comprises an advertising device affixed to a sleeve, said advertising device extending upwardly and being provided with advertising indicia viewable by an observer, and means for permanent mounting of said sleeve on an upper part of one of said barrels in a manner so as to permit said rotation of one of said barrels.

4. A writing instrument in accordance with claim 1 wherein said push-button is depressed by depression of said advertising device.

5. A writing instrument in accordance with claim 4 wherein said advertising device includes a planar member having opposite faces and wherein said advertising indicia is provided on at least one of said faces.

6. In a writing instrument of the type including a retractable and extendable writing tip actuated by a pushbutton or rotating barrel, an improvement which comprises an advertising device attached to a sleeve with an upstanding spindle portion permanently mounted to said barrel or pushbutton and allowing movement of the writing tip, said advertising device comprising a planar shaped member with indicia whereby said sleeve spindle portion permits said planar shaped member to rotate about a vertical axis.

7. On a writing instrument including a retractable and extendable writing tip actuated by a pushbutton or rotating band barrel, an improvement which comprises an advertising device attached to a sleeve with an upstanding spindle portion permanently mounted to said barrel or said pushbutton and said sleeve having an upstanding first support member with a vertical axis and an upstanding second support member with a vertical axis, said members being arranged in a laterally spaced relationship, a first planar member mounted for free rotation about the vertical axis on said first support member and a second planar member mounted for free rotation about the vertical axis of said second support member.

8. In a writing instrument including a retractable and extendable writing tip actuated by a pushbutton or rotating barrel, an improvement which comprises an advertising device attached to a sleeve with an upstanding portion permanently mounted to said barrel or said pushbutton, said advertising device including a yoke having a pair of leg portions and a base portion, said base portion including a sleeve, and a disc having opposite faces, at least one of said faces having advertising indicia thereon, said disc having a pair of laterally extending horizontal spindles on opposite sides thereof and means on said leg portions for accommodating said spindles for free rotation of said disc between said leg portions.

9. A writing instrument in accordance with claim 8 wherein said disc includes an illuminating device, a source of power, and means including a switch for connecting said source to said illuminating device.

10. In a writing instrument of the type including a retractable and extendable writing tip actuated by a pushbutton or rotating barrel, an improvement which comprises an advertising device having a hollow tubular member attached to a sleeve with an upstanding spindle portion affixed to said barrel or pushbutton, said tubular member having an open upper end and a serpentine member positioned within said tubular member for movement by gravity between a retracted position within said tubular member and a position extending outwardly from said tubular member open end.

* * * * *